US006201172B1

(12) United States Patent
Denton

(10) Patent No.: US 6,201,172 B1
(45) Date of Patent: Mar. 13, 2001

(54) ADJUSTABLE HANDLE MOUNTING MECHANISM FOR TREMOLO DEVICES

(76) Inventor: Paul Denton, 9859 Appletree Pl., Thornton, CO (US) 80260

( * ) Notice: Subject to any disclaimer, the term of this patent is extended or adjusted under 35 U.S.C. 154(b) by 0 days.

(21) Appl. No.: 09/521,726

(22) Filed: Mar. 9, 2000

(51) Int. Cl.[7] ..... G10D 3/00
(52) U.S. Cl. ..... 84/313
(58) Field of Search ..... 84/313

(56) References Cited

U.S. PATENT DOCUMENTS

| | | | | |
|---|---|---|---|---|
| 4,604,936 | * | 8/1986 | Page et al. | 84/313 |
| 4,970,930 | * | 11/1990 | Secord | 84/306 |
| 5,046,393 | * | 9/1991 | Xenidis | 84/313 |
| 5,637,817 | * | 6/1997 | Sherman | 84/313 |

* cited by examiner

*Primary Examiner*—Shih-Yung Hsieh

(57) ABSTRACT

An improved and adjustable handle mounting mechanism for tremolo devices of stringed instruments and of the type having a string engaging saddle (22) floating in a centered position under opposing forces of the instrument's strings and a return spring (24)(FIGS. 1 and 8). The mechanism (10) comprises a plurality of rotatably interconnected parts which are held under compressive friction by a retaining screw (18), and includes a uniquely shaped washer (16) and uniquely configured attachment means (FIGS. 3 and 7), wherein the handle's support post (14) is separably attached to the saddle: the saddle has a convexly curved top surface (22*a*) and includes a slot (22*c*), and the undersurface (14*d*) of the post is concaved to mate it with the saddle (FIG. 7). An adjustment screw (20*a*) passes upward through the slot in the saddle and into a threaded hole (14*c*) in the post. An adjustment guide (20) can provide additional stability, but is not vital to the connection. Tightening of the screw (20*a*) draws the post down against the saddle. Adjustment can be made to the angle of attachment by partially loosening the adjustment screw and moving the post and screw along an axis in line with the slot (FIGS. 6A and 6B). The ability to make this adjustment, while the instrument's strings are tuned and the handle is on the post, is provided by removing the retaining screw (18), to expose the slot (20*b*) of the adjustment screw, so that it can be reached with a screwdriver through the threaded hole in the post. Referring back to the washer (16) above, it is uniquely shaped in that it has a raised face or hub on one side which is smaller in diameter than the inside diameter of the cylinder (12) portion of the handle (FIG. 7), so that when the retaining screw is tightened down, the hubbed area of the washer transfers greater force to the post's top surface (14*a*) than the remainder of the washer transfers to the cylinder's top surface (12*a*), effectively binding the screw to the post, and overcoming the larger surface area and greater frictional drag of the cylinder during lateral rotation of the handle, which would otherwise cause unintentional and unwanted loosening of the retaining screw.

1 Claim, 3 Drawing Sheets

ADJUSTABLE HANDLE MOUNTING MECHANISM FOR TREMOLO DEVICES

BACKGROUND

1. Field of Invention

This invention relates to mechanical tremolo devices for stringed instruments such as guitars, and more specifically to a tremolo handle mounting mechanism.

2. Description of Prior Art

There have been numerous tremolo or vibrato devices described in prior patents. Many of the features embodied in the device discussed herein were achieved in one or more such prior patents. The patent which embodies features most nearly connected to the present invention in general shape and principles of operation is U.S. Pat. No. 3,056,329 to Paul D. Butts (1962). The string engaging saddle, spring, and tailpiece as described in that prior patent are shaped very nearly the same and operate under the same principle as described below, except that the handle mounting mechanism differs from the marketed version. The modified handle mounting mechanism was not patented, but was included in the marketed versions of the device. A description of this mechanism is given hereinafter, in order that the present invention may be clearly understood. The basic features of the above cited tremolo device are as follows:

(1) a tailpiece which fastens to a musical instrument on one end and a spring on the other end;

(2) a spring in the shape of a curved plate with ends bent to form attachment clips;

(3) a string engaging saddle which engages both the spring and the strings of a musical instrument, and;

(4) a handle with mechanism attaching it to the string engaging saddle.

The above parts are held together and fastened to a musical instrument by various means. The assembled parts form a mechanical tremolo device. The string engaging saddle floats in a centered position under the opposing forces of the instrument's strings on one hand, and the spring on the other hand. The device produces a tremolo effect when a musician playing the instrument moves the string engaging saddle back and forth across it's centered position by means of the attached handle. The above movement alternately loosens and tightens the tension of the strings, thereby lowering or raising the pitch of the sound produced by the strings. The handle may be rotated laterally to move it out of the way of the player's hand, when he or she does not wish to use the tremolo. To facilitate this lateral rotation, the handle is attached to one side of a cylindrical shape on it's mounting end, with flat surfaces on the top and bottom of the cylinder, parallel with each other and perpendicular to the cylinder's sides. The cylinder slips over a permanently attached round post projecting outwardly from the string engaging saddle to a length approximately equalling the depth of the cylinder's sides. The post is flat on top and is provided with a threaded hole extending down through it's center and a flat surface around it's base to mate with the bottom of the handle's cylindrical end. The assembly of these rotatably interconnected parts is retained from relative separation by a headed screw with a flat ring washer of suitable resilient material interposed between the screw head and the top of the post and cylinder. The screw is intended to hold the handle in any desired position when appropriately tightened. The handle mounting mechanism described above is not covered by any patent of which the applicant is aware, but has been in use for many years; therefore, is described herein only so that the improvements embodied in the present invention can be clearly illustrated.

There are two deficiencies of the string mounting mechanism described above wherein improvements are believed by the applicant to be desirable, new, and useful: (1) the screw that secures the handle tends to loosen unexpectedly while the instrument is being played, allowing the handle to drop out of it's lateral position, and; (2) no provision has been made, short of removing and permanently bending the handle, for adjusting it's height at the unsupported end where the player grasps it Since the player pushes this unsupported end of the handle down toward the top surface of the instrument to lower the string tension, or pulls it up away from the top surface to raise the string tension, the handle's unsupported end needs to be at an appropriate level in order to be used effectively and comfortably.

In analyzing deficiency (1) described on page 2 above, it was found that excessive frictional drag will occur between the handle cylinder's top and the washer and screw. The design of the prior art device did not take into account the fact that equal force would be applied to unequal bearing surfaces. The top of the cylinder, having a larger diameter than the post, has a greater bearing surface area than the top of the post, which results in more total frictional drag on the cylinder's bearing surface than is imposed on the bearing surface on the top of the post. Since the post cannot rotate, the washer is carried in rotation with the cylinder by the greater friction, often rotating the screw with the washer. Adding to the problem, the bearing surfaces tend to develop unevenness; in effect, they tend to become tight in one rotational position, and loose in another, causing the flat washer to bind up on the bottom of the screw head and the top of the cylinder when the handle is rotated clockwise. Then when the handle is rotated counter-clockwise, the screw and washer turn with the cylinder, loosening the assembly and allowing the handle to fall out of it's position when released by the player.

The deficiency of (2) described on page 2 above, was not addressed in the cited U.S. Pat. No. 3,056,329 or in it's unpatented modifications. Other patents may have provided a means to adjust the handle height in various designs and types of tremolos, but to my knowledge, no means of adjustment has been provided for the particular style of tremolo discussed herein, specifically the type of handle mounting mechanism considered above. A user of this type of tremolo has heretofore been required to remove the handle, bend it in a vise or something similar, and reinstall it in order to change the height. This height of the unsupported end of the handle is dependent upon the angle at which the string engaging saddle comes to rest when the spring tension versus the collective tension of all the instrument's strings is equalized. Many different gauges of strings are available; light, medium, and heavy, with various combinations offered in sets or individually by several competing manufacturers. Heavy gauge strings apply more tension on the spring than light gauge strings do, pulling the handle down toward the top of the instrument. Conversely, light gauge strings apply less tension on the spring than do heavy gauge strings, so that the unsupported end of the handle rests relatively higher. One can see that the height of the tremolo handle can not be accurately predicted, either when the device is first installed and strings attached and tuned, or when a set of strings is put on the instrument which are lighter or heavier than the user has adjusted the handle height for. For this reason, an easy adjustment is needed.

OBJECTS AND ADVANTAGES

Accordingly, several objects and advantages of the present invention are:

(a) to provide a tremolo handle mounting mechanism wherein the handle is laterally rotatable and will not unexpectedly loosen and drop out of reach of the player's hand, as is the case with many tremolos in present use;

(b) to provide a tremolo handle mounting mechanism in which said handle's lateral position may be intentionally changed or rotated repeatedly with a degree of frictional resistance conveniently controllable by the user;

(c) to provide a tremolo handle mounting mechanism with an adjustment means whereby the angle of the handle relative to the plane of an instrument's top may be conveniently changed after the strings have been engaged to the string engaging saddle and tuned to the proper pitch, with the tremolo handle and all of it's associated mounting mechanism (except a retaining screw) remaining attached to the string engaging saddle of the tremolo device installed on the instrument.

Further objects and advantages of my invention will become apparent from a consideration of the drawings and ensuing description.

DRAWING FIGURES

In the drawings, closely related figures have the same number but different alphabetic suffixes.

REFERENCE NUMERALS TO DRAWINGS

| | | | |
|---|---|---|---|
| 10 | handle mounting mechanism | l0a | handle |
| 12 | cylinder at end of handle | 12a | top bearing surface of cylinder |
| 12b | bottom bearing surface of cylinder | 14 | post |
| 14a | topbearing surface of post | 14b | bearing surface around base of post |
| 14c | threaded hole | | |
| 16 | hubbed washer | 14d | bottom surface of post |
| 20 | adjustment guide | 18 | retaining screw |
| 20b | screwdriver slot | 20a | adjustment screw |
| 22a | top surface of saddle at handle mounting | 22 | string engaging saddle |
| 22c | slot | 22b | bottom surface of saddle at handle mounting |
| 26 | tailpiece | 24 | spring |

DESCRIPTION—FIGS. 1 TO 8

Figure 1:
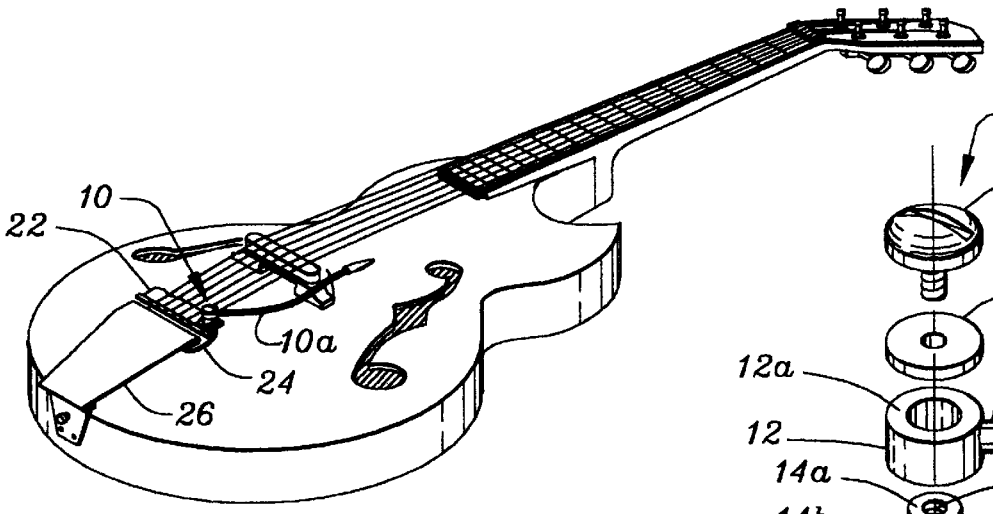
FIG. 1 shows a perspective view of a guitar with a relevant type of tremolo device attached.
Figure 8:
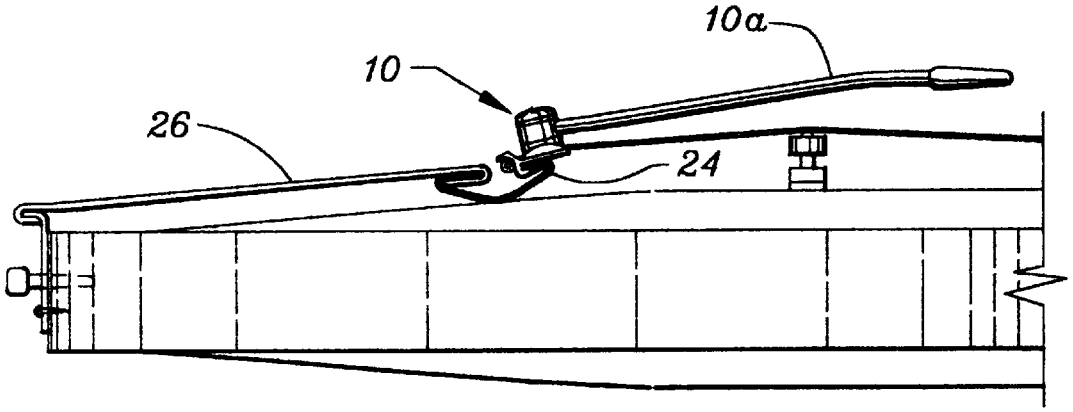
FIG. 8 shows a partial side view of a guitar and relevant type tremolo device, and is included only to provide additional clarification.

A typical relevant tremolo device attached to a guitar is shown in FIG. 1 for illustration of the most common application of the device. The drawing illustrates the preferred embodiment of a tremolo of the specific type most nearly connected to the present invention, with reference numerals pointing to the basic parts. FIG. 8 is included in order to further clarify the device's form and function for the reader by showing a partial side view of a guitar with a tremolo of the type most relevant to this discussion. In FIG. 1, the location of handle mounting mechanism 10 is shown, relative to the other basic elements of a tremolo, namely, string engaging saddle 22, spring 24, and tailpiece 26. Handle mounting mechanism 10 attaches to string engaging saddle 22; saddle 22 fastens onto spring 24; spring 24 fastens onto tailpiece 26, and tailpiece 26 is attached to the peg end of a guitar.

Figure 2:
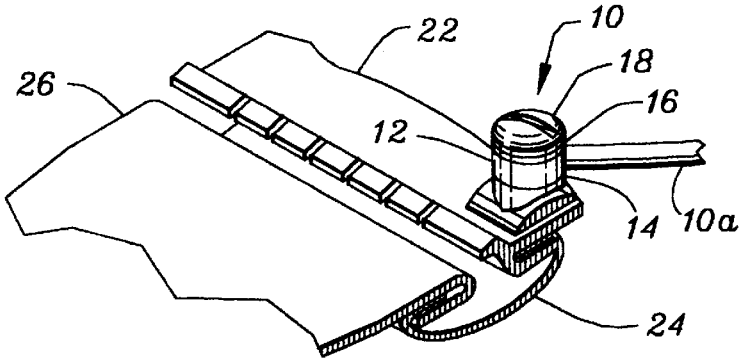
FIG. 2 shows an enlarged partial perspective view of a relevant type of tremolo device.

FIG. 2 is presented as an enlarged partial perspective view of a tremolo in order to more clearly illustrate how the elements of handle mounting mechanism 10 fit together, and how string engaging saddle 22 is positioned with relation to spring 24 and tailpiece 26.

Figure 3:
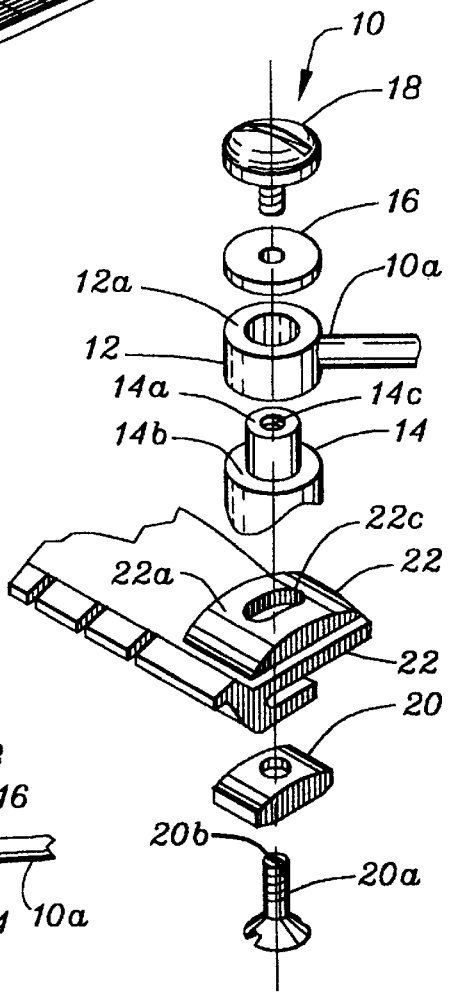
FIG. 3 shows an exploded perspective view of a tremolo handle mounting mechanism.

The exploded perspective view of the preferred embodiment of handle mounting mechanism 10 in FIG. 3 shows the manner in which handle 10*a*, cylinder 12, and post 14 join together to form a laterally rotatable assembly which is fastened to string engaging saddle 22 by passing adjustment screw 20*a* through adjustment guide 20 and slot 22*c* and threading into threaded hole 14*c*. The surface referred to as top of saddle at handle mounting 22*a* is convexly curved to facilitate adjustment of the angle of handle 10*a* relative to the plane of an instrument's top. Adjustment guide 20 is not necessary to the principle of the adjustment, but will reduce wear and surface marring on slot 22*c*, and provide additional stability.

Figure 4:
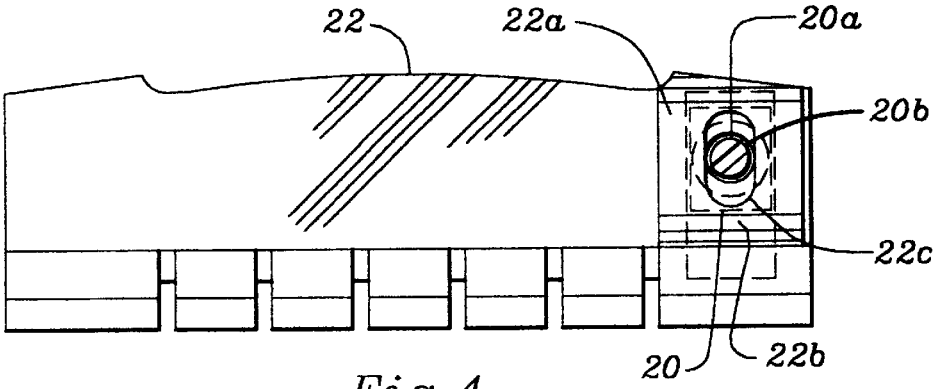
FIG. 4 shows a top view of a string engaging saddle with adjustment screw partially hidden.

FIG. 4 shows a top view of string engaging saddle 22, with the upper end of handle mounting mechanism 10 omitted so the lower end could be shown, partly in hidden line. This drawing shows the position of slot 22*c* in string engaging saddle 22, which slot 22*c* accommodates adjustment screw 20*a*. It can be seen that screw 20*a* is provided with screwdriver slot 20*b* on the threaded end thereof, which is normally the top end when installed. Screwdriver slot 20*b* is for the purpose of accessing and loosening or tightening adjustment screw 20*a* from the top. It can be seen by referring back to FIG. 3 that retaining screw 18 can be removed to gain access to screwdriver slot 20*b*, and by loosening adjustment screw 20*a*, adjustment of the angle of handle 10*a* relative to the plane of the instrument's top can be made. After this adjustment is made, adjustment screw 20*a* can be again tightened and retaining screw 18 can be reinstalled and tightened to provide the desired frictional resistance for lateral movement of handle 10*a*.

Figure 5:
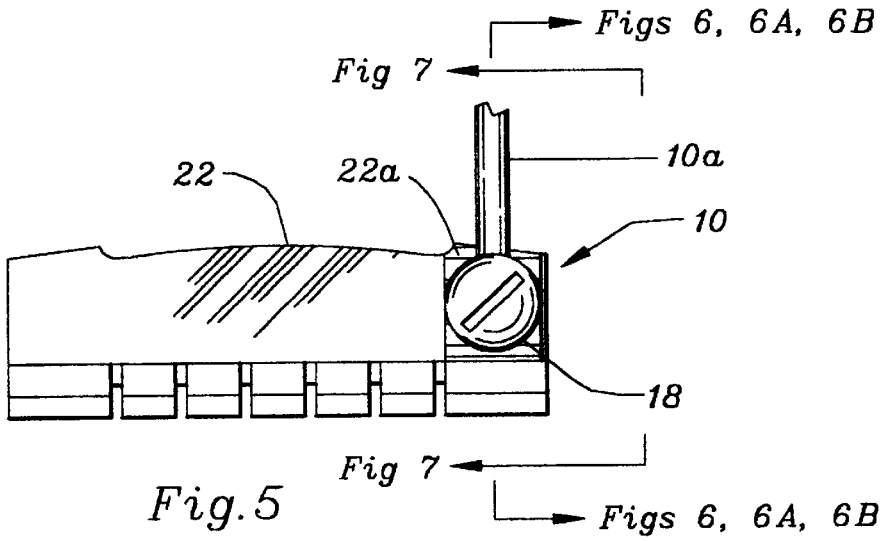
FIG. 5 shows a top view of a string engaging saddle with handle mounting mechanism.

FIG. 5 is a top view of string engaging saddle 22 showing handle mounting mechanism 10, partial handle 10*a*, exposed portion of top of saddle 22*a*, and retaining screw 18. This view also shows where the sections are cut for FIGS. 6, 6A, 6B, and 7.

Figure 6:
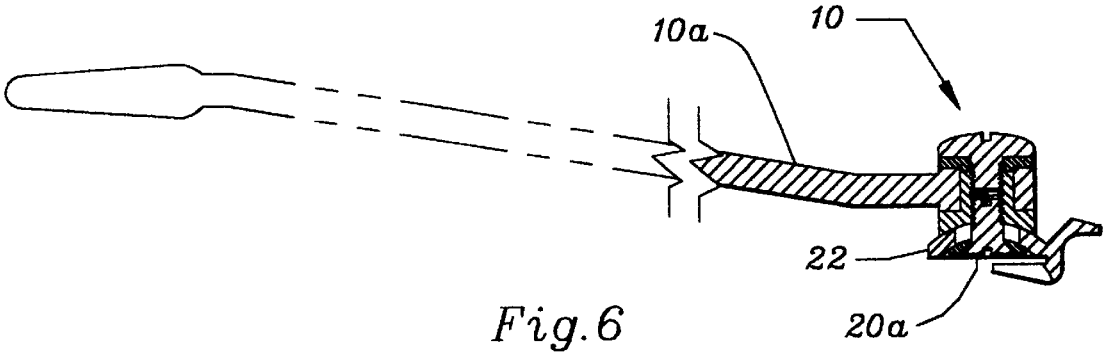
FIG. 6 shows a cross-sectional end view of a string engaging saddle and a handle mounting mechanism.
Figure 6A:
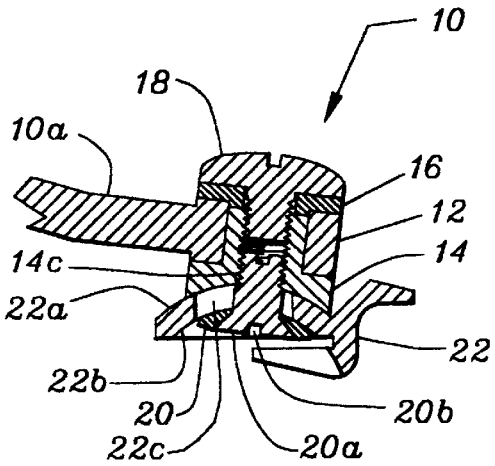
FIG. 6A shows an enlarged cross-sectional end view of a string engaging saddle and handle mounting mechanism with handle adjusted upward.
Figure 6B:
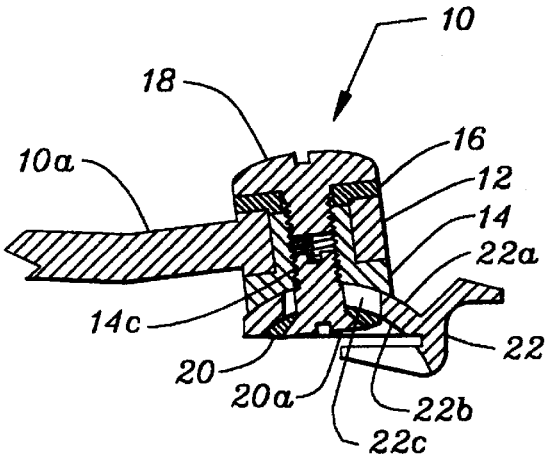
FIG. 6B shows an enlarged cross-sectional end view of a string engaging saddle and handle mounting mechanism with handle adjusted downward.
Figure 7:
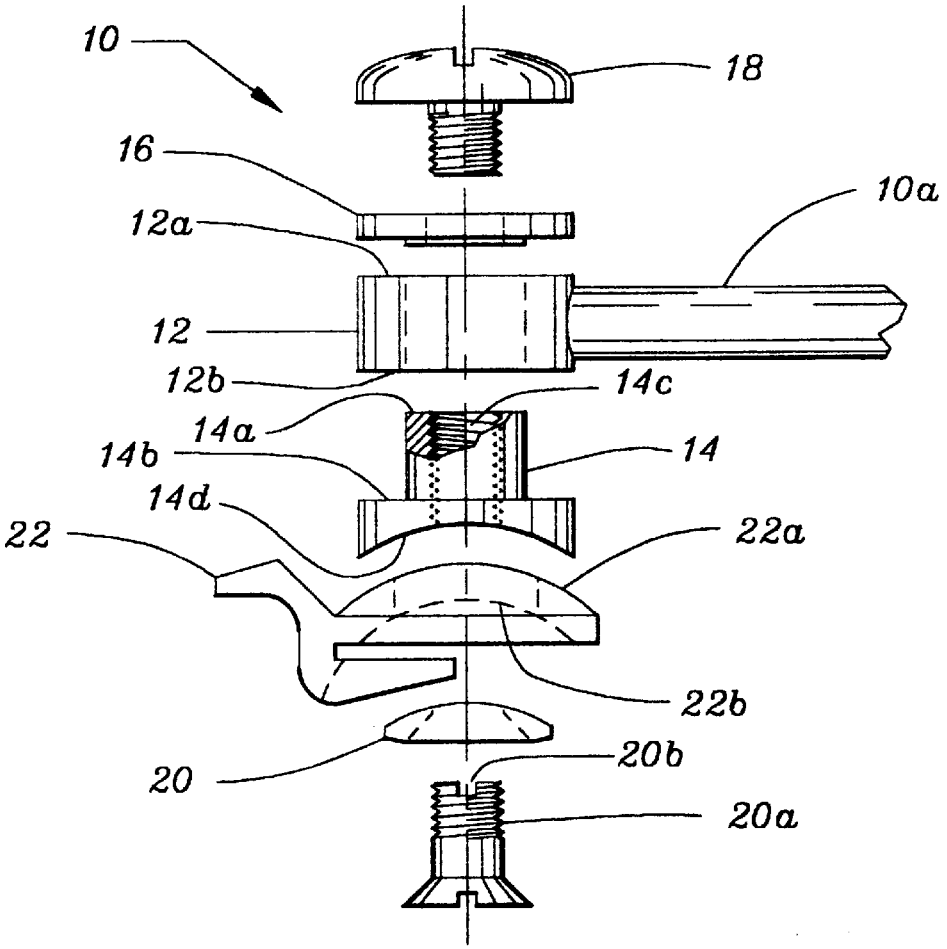
FIG. 7 shows an enlarged, exploded end view of a string engaging saddle with handle mounting mechanism.

FIG. 6 shows handle mounting mechanism 10 and string engaging saddle 22 in cross-section. Handle 10*a* is illustrated in the central position of the possible range of adjustment. FIG. 6A shows an enlarged cross-sectional view of the same elements as FIG. 6, but with greater detail and with handle 10*a* parked in the position which elevates it's unsupported end upward to the approximate upward limit of the adjustment range. Conversely, FIG. 6B shows the same elements and detail as FIG. 6A, but with handle 10*a* parked in the position which lowers it's unsupported end downward to the approximate downward limit of the adjustment range. These two enlarged views show all parts comprising the preferred embodiment of the prior art assembled and incorporated with the present invention in cross-section. FIG. 7 is presented in a larger scale, exploded end view, in order to show all these parts separately, with reference numerals identifying specific surfaces more clearly. FIG. 8 is included for the purpose of providing additional clarification, showing a partial side view of a guitar having a relevant type tremolo combined with the preferred embodiment of my handle mounting mechanism.

Referring to FIGS. 6, 6A, 6B, and 7, the reader will note that the underside of retaining screw 18 tightens down against the flat top side of hubbed washer 16, which is made of a suitable resilient material such as nylon. The hubbed portion of the underside of washer 16 in turn tightens down against the flat top bearing surface 14*a* of post 14, and cold flow of the resilient material of washer 16 will accommodate any small manufacturing irregularities to make operation of this connection very smooth In conjunction, the remainder of the underside of washer 16 tightens down against the top bearing surface 12*a* of cylinder 12, which encircles post 14, and from which handle 10*a* extends. The bottom bearing surface 12*b* of cylinder 12 tightens down against the bearing surface 14*b* around the base of post 14. All of the above tightening is accomplished by screwing retaining screw 18 into threaded hole 14*c*.

Continuing, the bottom surface 14*d* of post 14, which is concave in the shape of a segment of the inside of a hollow cylinder, tightens down against the top surface 22*a* of string engaging saddle 22, which surface 22*a* is convex in the shape of a segment of a cylinder to mate with surface 14*d*. The bottom surface 22*b* of saddle 22 is concave, similar to 14*d*, having a radius which is sufficiently smaller than that of surfaces 14*d* and 22*b* to match the thickness of the material of saddle 22 at the location of the mounting mechanism 10. The top surface of adjustment guide 20 is convex to mate with surface 22*b*, and is tightened up against surface 22*b* by means of adjustment screw 20*a*. Screw 20*a* passes through a countersunk hole in guide 20, continues upward through slot 22*c* in saddle 22, and screws into threaded hole 14*c*. Screw 20*a* secures post 14 and guide 20 to saddle 22, and screwdriver slot 20*b* provides the means for making adjustments to the angle of handle 10*a* relative to the horizontal plane of the tremolo device and instrument onto which it is attached.

As an aside, it should be noted that either or both of the surfaces 14*d* and 22*a* can be circular and smooth as described above, or in steps, corrugations, a polygon, or other similar shape, and still be workable.

From the description above, some advantages of my adjustable handle mounting mechanism become evident:

(a) The entire mechanism can be removed from the string engaging saddle and repaired or replaced, if so desired.

(b) Adjustment can be made to set the angle of the handle relative to the horizontal plane of the instrument by removing only the retaining screw. Expressed differently, this provides a means to change the height at the unsupported end of the handle after an instrument's strings have been tuned up to pitch, and while the handle is still resting over the post on a tremolo's string engaging saddle. It is important to be able to make the adjustment with the handle in place and the strings tightened, because without these conditions, a player can not know exactly what the handle's angle needs to be.

(c) The hub provided on the washer to be interposed between the retaining screw and the top of the post is a slight, yet significant modification to the flat washer used in the prior art handle mounting. In the present invention, this hub comes in contact with the top of the post (which can not rotate) slightly before contacting the top of the cylinder. When the retaining screw is tightened down, the hub portion of the washer exerts considerably more force on the post than the remaining flat portion of the washer exerts on the top of the cylinder, thereby overcoming the greater surface friction area of the cylinder. This allows the handle to be rotated laterally back and forth repeatedly without loosening the retaining screw.

OPERATION

The manner of using my mechanism, attached to a tremolo as described in the preceding text, with such a tremolo attached to a guitar as shown in FIGS. 1 and 8 in the drawings, is identical in most basic aspects to that for tremolos in present use. Namely, a player first strums the guitar strings. Next, the player grasps the handle of the tremolo and moves it either downward toward to guitar's top (which movement lowers the tension of the strings) or upward away from the guitar's top (which movement raises the tension of the strings), or alternately downward and upward, thereby producing a true tremolo or vibrato in the sustained tones of the instrument's strings. When using my handle mounting mechanism as just described, the foregoing basic functions are unchanged. Rather, my present invention offers a solution to two problems which players have long experienced with the tremolo handle's position while performing the above functions. In the text under "Background—Description of Prior Art" above on pages 2 and 3, I referred to the above two problems as deficiencies (1) and (2). In deficiency (1), the screw that retains a tremolo's handle tends to loosen unexpectedly, allowing the handle to fall out of the player's convenient reach. The addition of a raised hub to the underside of washer 16 (FIG. 7) prevents unintentional loosening of retaining screw 18 by exerting greater force onto post 14 than is exerted onto cylinder 12. The greater force has the effect of locking the washer 16 and screw 18 to post 14, while the lesser force exerted onto cylinder 12 allows the cylinder to be rotated laterally by intentional movement of handle 10*a* by a player. A suitable frictional resistance to such movement is achieved by appropriate tightening of screw 18.

The manner of using the portion of the present invention which solves the second problem mentioned above (referring to deficiency (2) on pages 2 and 3) is to first unscrew and remove the retaining screw 18 from handle mounting mechanism 10. Secondly, insert a screwdriver down into threaded hole 14*c* and position it's end firmly into screwdriver slot 20*b*. Thirdly, twist the screwdriver clockwise, loosening screw 20*a* only a sufficient amount to allow movement of handle mounting mechanism 10 backward or forward in line with slot 22*c* (FIG. 3 and FIG. 4). Next, move mechanism 10 back toward the peg end of the guitar to raise the unsupported end of handle 10*a*, or forward toward the neck of the guitar to lower the unsupported end of handle 10*a*. Then tighten screw 20*a* with the screwdriver, twisting counterclockwise until mechanism 10 is again firmly attached to saddle 22. Lastly, replace retaining screw 18, tightening it until a suitable frictional resistance for lateral rotation of handle 10*a* is achieved.

As an aside, it should be noted that there are other types of fasteners beside slotted screws which could be utilized in place of the slotted screws described above. Allen sockets, hex heads, and other types could possibly serve the purpose. Another item to be noted is the raised hub added to the washer shown in FIG. 7, which could be a separate ring of material placed under a flat washer. These and other minor changes may be made without altering the principle or operation of the mechanism and still fall within the spirit and scope of the present invention.

CONCLUSION, RAMIFICATIONS, AND SCOPE OF INVENTION

Accordingly, the reader will see that the adjustable handle mounting mechanism of this invention can be used easily and conveniently, can be removed easily for repairs or replacement, and can be adjusted to suit the requirements and preferences of individual users. In addition, when the mechanism has been used to make adjustments to suit a specific set of conditions, and later the user wishes to readjust for a different set of conditions, such adjustments as are described above can be made easily and conveniently without any damage to the mechanism. Furthermore, the mechanism has the additional advantages in that:

(a) It is very smooth in operation, without the typical slackness associated with most tremolo handle mounting mechanisms in present use, due in large part to the design of the hubbed washer and the improved cold flow of the resilient material afforded by the narrow hub;

(b) It has an appearance of quality; of being sturdy without being overly bulky, which makes it desirable for use on other styles of tremolos in addition to the style described above;

(c) It is a highly reliable, economical device which can be used by persons of almost any age.

Although the description above contains many specificities, these should not be construed as limiting the scope of the invention but as merely providing illustrations of some of the presently preferred embodiments of this invention. For example, the string engaging saddle can have other shapes, such as flat on top with the addition of an element that is rounded on top and bottom, or polygonal, or square with partially rounded surfaces, etc.

Thus the scope of the invention should be determined by the appended claims and their legal equivalents, rather than by the examples given.

I claim:

1. A tremolo handle mounting mechanism comprising:

a handle terminating in a hollow cylinder;

a round post having a threaded hole through its center and a base upon which an end of said cylinder comes into laterally rotatable contact, said post having a concave bottom surface;

a retaining screw engaging one end of said threaded hole of said post via a hubbed washer on top of said cylinder, said washer being made of resilient material;

a string engaging saddle having a slot, a concave bottom surface, and a top convex surface to mate with said concave bottom surface of said post;

an adjustment guide having a convex top surface to mate with said concave bottom surface of said saddle;

an adjustment screw engaging other end of said threaded hole of said post through said adjustment guide and said slot of said saddle such that an attachment angle of said handle relative to an instrument top can be changed.

* * * * *